United States Patent [19]

Sampson et al.

[11] 4,093,268

[45] June 6, 1978

[54] PLASTIC DRAG REDUCING SURFACING MATERIAL

[75] Inventors: Ronald N. Sampson, Murrysville; Zal N. Sanjana, Penn Hills, both of Pa.

[73] Assignee: Westinghouse Electric Corp., Pittsburgh, Pa.

[21] Appl. No.: 733,593

[22] Filed: Oct. 18, 1976

[51] Int. Cl.[2] ..... A63C 5/04

[52] U.S. Cl. ..... 280/610; 260/17 R

[58] Field of Search ..... 280/610, 601, 28; 9/310 A, 310 E; 260/17 R, 16; 160/272

[56] References Cited

U.S. PATENT DOCUMENTS

| | | | |
|---|---|---|---|
| 2,494,531 | 1/1950 | Dissel et al. | 106/271 |
| 3,416,810 | 12/1968 | Kennedy | 280/610 |
| 3,707,296 | 12/1972 | Palazzolo et al. | 280/610 |
| 3,785,841 | 1/1974 | Beard | 106/271 |
| 4,018,729 | 4/1977 | Faucher | 260/17 R |

FOREIGN PATENT DOCUMENTS

| | | | |
|---|---|---|---|
| 1,238,541 | 7/1960 | France | 280/601 |
| 2,246,540 | 3/1973 | Germany | 280/601 |

*Primary Examiner*—David M. Mitchell
*Attorney, Agent, or Firm*—D. P. Cillo

[57] ABSTRACT

A substrate, useful as the base layer on a snow ski is made, comprising a rigid plastic matrix and from about 5 wt.% to about 45 wt.% of a thermoplastic, water soluble polymer disposed within the plastic matrix; wherein the substrate provides a surface where the water soluble polymer will be leached out of the rigid plastic matrix upon contact with water; to provide a boundary lubricant film.

10 Claims, 2 Drawing Figures

PLASTIC DRAG REDUCING SURFACING MATERIAL

BACKGROUND OF THE INVENTION

Ski running surfaces made from polyethylene, epoxy, polyurethane, polyvinylalcohol, polyvinylchloride, polypropylene and polytetrafluoroethylene plastics are well known and taught by Kennedy in U.S. Pat. Nos. 3,272,522 and 3,416,810. The running surface may contain a lubricating filler such as powdered graphite or molybdenum disulfide. This outer surface is generally bonded to the ski body, which may be a solid polymer foam, with a catalyzed adhesive impregnated Dacron, fiberglass or cotton cloth reinforcement.

While such particulate lubricant inclusion helps to reduce drag between the ski running surface and the snow, the spaced apart particles do not provide a continuous lubricating surface. They also tend to easily wear off the ski surface due to friction with the snow.

Dissel, in U.S. Pat. No. 2,494,531, in attempting to solve ski drag problems, taught a combination lacquer-wax, containing bayberry or paraffin wax, nitrocellulose, and the calcium salt of dioctyl-succinic acid. This provided a very adherent, easily replaceable wax, having a very low coefficient of friction, which could be easily applied to the running surfaces of a ski.

In a related area, Beard, in U.S. Pat. No. 3,785,841, taught a wax combination, containing paraffin wax and ethyl cellulose or an oleyl amide resin. This provided a very adherent wax, that was moisture repellant, had a low adhesion to snow, and was particularly useful on snow shovels. All waxes, of course, easily wear off ski surfaces and must be frequently reapplied.

What is needed is a ski, with a running surface having materials incorporated therein that will provide a continuous, frictionless surface upon contact with water, providing ultra, high performance characteristics.

SUMMARY OF THE INVENTION

The above need is met by providing a self-lubricating substrate which may be used as a base layer for a ski, preferably a snow ski comprising a core bonded to the lubricating substrate base layer. The substrate comprises a rigid, plastic, non-water soluble matrix, preferably of polyethylene; and from about 5 wt.% to about 45 wt.% of a thermoplastic, water soluble polymer disposed within the plastic matrix. The water soluble polymer is preferably selected from polyacrylamide, carboxy methyl cellulose, sodium carboxy methyl cellulose, polysaccharide, guar gum, vinyl pyridine, poly (ethylene oxide) and their mixtures. The substrate is effective to provide a surface wherein the water soluble polymer will be leached out of the rigid plastic matrix upon contact with water, to provide a boundary lubricant between the base layer and the snow, ice or water.

BRIEF DESCRIPTION OF THE DRAWINGS

For a better understanding of the invention, reference may be made to the exemplary embodiment shown in the accompanying drawings, in which.

DESCRIPTION OF THE PREFERRED EMBODIMENTS

Figure 1:
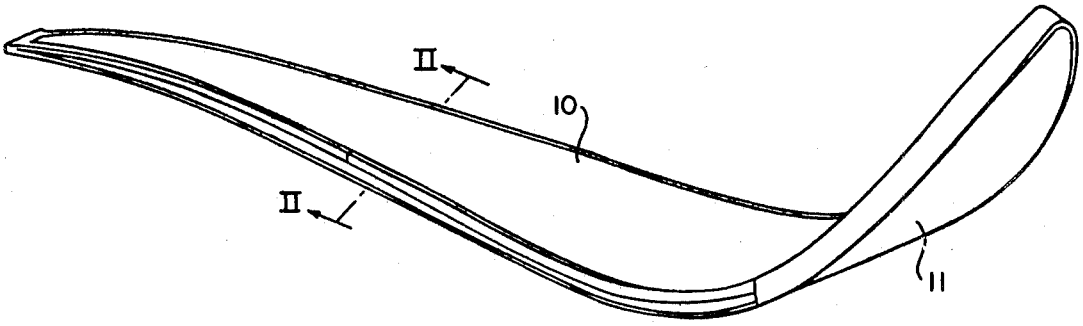
FIG. 1 shows, in three dimensional view, a ski having the drag reducing ski running surface of this invention.

Referring now to the drawings, FIG. 1 shows a high performance ski 10, having the bonded, drag reducing, base ski running layer 11 of this invention.

Figure 2:
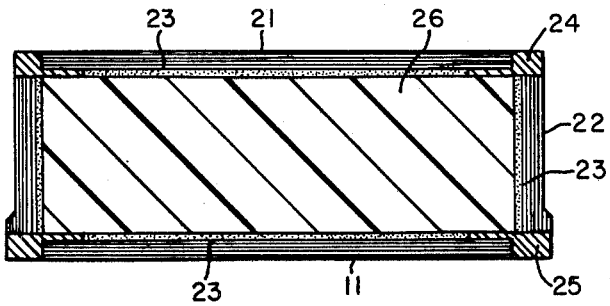
FIG. 2 shows, in cross section, the ski of FIG. 1, including the bonded base, ski running surface of this invention.

FIG. 2 shows a cross sectional view of the ski shown in FIG. 1. Skis are generally made by a sandwich construction, wherein the top surface 21, sidewall 22 and bonded, bottom, ski running surface base 11, cover reinforcing adhesive layers 23, which may comprise fiberglass, Dacron, rayon or cotton cloth, used alone or impregnated with epoxy, polyester or other suitable adhesive resin. On the sides of the reinforcing layers 23, edge protector strips 24 and 25, made of a metal, generally aluminum, may be applied. The core 26 of the ski, which is highly flexible for snow skis, is surrounded by a top surface layer, a bonded, bottom ski running base layer, and sidewalls between the top surface and base.

The core 26, in high performance skis, can be a hollow or solid plastic core of epoxy resin reinforced fiberglass, a lightweight epoxy, polystyrene or polyurethane foam, an aluminum honeycomb, or a suitable, pressed, lightweight, wood core. The top and sidewall surfaces may comprise, for example, any suitable abrasion resistant plastic, such as polyvinyl chloride or polyacrylate, or a laminate of malamine, phenolic or modified phenolic impregnated paper sheets.

The ski surfacing base layer can comprise epoxy resin, polyurethane resin, melamine resin, polyvinyl alcohol resin, polyvinyl chloride resin, polypropylene resin, polytetrafluoroethylene resin, polyester resin and preferably polyethylene resin, among others. Preferably, polyethylene is used, and is of a high density grade, having a density range of between about 0.93 gram/cu.cm. to about 0.97 gram/cu.cm. and a melt flow index of between about 0.01 and about 0.4 (grams of a thermoplastic which can be forced through a 0.0825 orifice at 5,000 grams force in 10 minutes at 250° C). These plastic materials will act as a rigid, plastic, nonwater soluble matrix for the lubricating additives of this invention.

The self-lubricating substrate matrix material, or the ski surfacing rigid plastic matrix material will contain from about 5 wt.% to about 45 wt.%, and preferably about 10 wt.% to about 30 wt.%, of a long carbon chain, thermoplastic, water soluble polymer, disposed and interdispersed within the plastic, non-water soluble matrix. This polymer will slowly dissolve and be leached out of its surrounding plastic matrix upon contact with the microlayer of water from the snow or ice on which the ski moves, to form a liquid, polymer containing film. This film acts as a continuous, frictionless, boundary lubricant, to reduce drag and dramatically increase the speed of travel of the ski.

The polymer containing film must provide at least 100 parts of water soluble polymer per 1,000,000 parts of water to provide adequate lubricity. Under about 5 wt.% water soluble polymer and no improvement in lubricity is observed. Over about 45 wt.% water soluble polymer and the ski surface will be weakened after only moderate use. Over about 45 wt.% water soluble polymer and extrusion and other sheet fabrication methods become difficult.

The number of carbons per molecule for suitable water soluble polymers will range between about 25 to about 225,000. Useful water soluble polymers include, for example, polyacrylamide $(CH_2CHCONH_2)_n$, carboxymethyl cellulose, sodium carboxymethyl cellulose, polysaccharide (nine or more monosaccharides linked with glycosidic bonds), guar gum (galactose, mannose and protein), vinyl pyridine and preferably poly (ethylene oxide) polymers. Particularly useful results have been obtained by using polymers of poly (ethylene oxide) having average molecular weights of from 100,000 to 5,000,000. These particulate hydratable polymers may be used alone or in mixtures. The polymers must be capable of being homogeneously mixed with the plastic material used as the ski surfacing, base layer matrix.

Generally, thermoplastic, water soluble polymer powder is mixed with a ski surfacing material, such as polyethylene pellets, by a tumbling mixer or other suitable process. The mixture may then be added to an extruder, and conventionally extruded into sheet form through a die. Cotton cloth, fiberglass, or other suitable interlayer bonding and reinforcing material can be attached to one side of the ski surfacing material by any suitable means, such as by pressure rolling at between about 100° C to about 120° C. The hot rolling partially resin impregnates the bonding-reinforcing material. The purpose of the cloth is to provide an inexpensive means to adhere the ski surfacing material to the ski body.

This provides an adhesive, cotton cloth-ski surfacing material laminate. This laminate can then be hot molded to an uncured epoxy resin impregnated fiberglass core or other suitable body of material, using conventional laminating techniques. Other means of improving bondability of the ski surfacing material surface, such as abrasion techniques, or propane or other suitable flame treatment can be used, and may eliminate the need for interlayer bonding-reinforcing material.

This can provide a ski, having a ski surfacing material, containing a water soluble polymer uniformly interdispersed throughout a resin matrix, which will not dissolve in water, laminated to the ski core. As the ski moves in friction contact with snow, ice or water, a continuous, frictionless, boundary lubricant polymer containing layer is formed, which dramatically increases ski speed without seriously degrading the ski surfacing layer.

EXAMPLE 1

A ski laminate was prepared. A self-lubricating substrate was made by adding 10 parts of poly (ethylene oxide) powder to 90 parts of high density extrusion grade polyethylene pellets. The poly (ethylene oxide) had a molecular weight of about 4,000,000 (sold commercially by Union Carbide under the trade name Polyox WSR-301). The polyethylene had a density range of between 0.955 to 0.963 gram/cu.cm. and a melt flow index of 0.35 gram/10 min. (ASTM D1238). The ingredients were tumble mixed for about ½ hour to homogeneously cover the pellets with the poly (ethylene oxide) powder.

The mixture was then added to the hopper of a Rainville Ed-Extruder with a 6 inches wide die, operating at between about 112 to 120 rpm. The mixture was conventionally formed into a 6 inches sheet at about 210° C to 220° C. This provided a homogeneous distribution of poly (ethylene oxide) water soluble polymer within an enclosing non-water soluble polyethylene matrix.

The extruded polyethylene-poly (ethylene oxide) sheet was passed through a set of spring-loaded chill rolls, at between 105° C and 118° C. At this point, cotton cloth interlayer reinforcement material was fed to the nip of polyethylene-poly (ethylene oxide) between the rolls. Under pressure of the rolls, and due to the molten state of the polyethylene-poly (ethylene oxide), the fabric adhered to the extruded sheet. This provided a high gloss, extruded substrate with an incorporated reinforced bonding layer on one side.

This reinforced extruded sheet was then laminated to an epoxy resin impregnated core composite by a wet lay-up method. Six sheets of fiberglass cloth impregnated with uncured epoxy resin were placed on top of the fabric side of the extruded sheet. The stack-up was then cured under contact pressure at 88° C for ½ hour, to provide a unitary consolidated laminate.

When the surface of the extruded polyethylene-poly (ethylene oxide) sheet was wetted with water and rubbed, the water dissolved and leached out a quantity of the poly (ethylene oxide), and excellent lubricity was observed. This constrasted with an extruded sheet, made as described above, containing polyethylene without any lubricating additive; which showed little lubricity when water was rubbed on its surface.

The results are tabulated below in TABLE 1:

TABLE 1

Coefficients of Friction Against Stainless Steel For Samples Wet With Water*

| Sample | Friction | Ave. Value 10 runs | Std. Deviation |
|---|---|---|---|
| 0.955 density PE + 10 wt.% polyox | static | 0.075 | 0.025 |
| | dynamic | 0.070 | 0.022 |
| 0.955 density PE : no polyox | static | 0.101 | 0.014 |
| | dynamic | 0.098 | 0.013 |

*Load = 5.7 lb./sq. in. and velocity = 0.03 in/min.

This data indicates an average 25% reduction of static friction, and an average 29% reduction of dynamic friction by using 10 wt.% of poly (ethylene oxide). Such improved lubricity would make the difference between a standard and an ultra, high performance snow ski, and such lubricity would be helpful in water skis as well. After the tests the surfaces were examined and neither one seemed to have been unduly worn or degraded.

Tests were also run to determine if adhesion to the fiberglass core was affected by the poly (ethylene oxide) addition. Ninety degree steady state peel strength for the sample containing 10 wt.% polyox was 16.75 lb./in.; ninety degree steady state peel strength for the sample not containing any poly (ethylene oxide) was 7.50 lb./in. Good peel strength is of course very important in competition type skis.

A ski laminate was also produced where the polyethylene-poly (ethylene oxide) ski running surface was flame treated with a hand-held propane torch to provide an adherable surface. This surface was heat and pressure laminated to a resin impregnated fiberglass core without the use of a resin impregnated cotton interlayer reinforcement and in one instance provided a ninety degree peel strength of 19.5 lb./in.

We claim:

1. A ski comprising a core bonded to a base layer, wherein the base layer comprises a rigid plastic matrix and from about 5 wt.% to about 45 wt.% of a thermoplastic, water soluble polymer disposed within the plastic matrix, wherein the base layer provides a surface where the water soluble polymer will be leached out of the rigid plastic matrix upon contact with water, to provide a boundary lubricant film on the layer surface.

2. The ski of claim 1, wherein the base layer is bonded to a reinforcing layer selected from the group consisting of fiberglass, Dacron, rayon and cotton cloth, said reinforcing layer disposed between the base layer and the ski core.

3. The ski of claim 1, wherein the water soluble polymer is selected from the group consisting of polyacrylamide, carboxy methyl cellulose, sodium carboxy methyl cellulose, polysaccharide, guar gum, vinyl pyridine, poly (ethylene oxide) and mixtures thereof.

4. The ski of claim 1, wherein the water soluble polymer is poly (ethylene oxide).

5. The ski of claim 3, wherein the water soluble polymer is present in the range of from about 10 wt.% to 30 wt.%.

6. The ski of claim 3, wherein the plastic matrix is selected from the group consisting of polyethylene plastic, epoxy plastic, polyurethane plastic, polyvinyl alcohol plastic, polyvinyl chloride plastic, polypropylene plastic, polytetraflouroethylene plastic, polyester plastic and mixtures thereof.

7. The ski of claim 6, wherein the water soluble polymer will be leached from the matrix at the rage of at least 100 parts of water soluble polymer per 1,000,000 parts of water in the snow to form a polymer containing lubricant film, and the plastic matrix is polyethylene.

8. The ski of claim 6 wherein the plastic matrix is polyethylene having a density of between about 0.93 grams/cu.cm. to about 0.97 grams/cu.cm.

9. A snow ski comprising a flexible core surrounded by and bonded to a top surface, base layer and sidewall surfaces between the top surface and base layer, wherein the base layer comprises a rigid polyethylene plastic matrix and from about 5 wt.% to about 45 wt.% of poly (ethylene oxide) disposed within the plastic matrix, wherein the base layer provides a surface where the poly (ethylene oxide) will be leached out of the rigid plastic matrix upon contact with snow at the range of at least 100 parts of ethylene oxide per 1,000,000 parts of water in the snow, to provide a boundary lubricant film on the base layer surface.

10. The snow ski of claim 9, wherein the base layer is bonded to a reinforcing layer selected from the group consisting of fiberglass, Dacron, rayon and cotton cloth, said reinforcing layer disposed between the base layer and the ski core.

* * * * *